US012108780B2

(12) United States Patent
Rogan et al.

(10) Patent No.: US 12,108,780 B2
(45) Date of Patent: Oct. 8, 2024

(54) METHOD AND APPARATUS FOR MANUFACTURING AEROSOL GENERATING ARTICLES

(71) Applicant: JT International S.A., Geneva (CH)

(72) Inventors: Andrew Robert John Rogan, Forres (GB); Lubos Brvenik, Krpelany (SK)

(73) Assignee: JT International S.A. (CH)

( * ) Notice: Subject to any disclaimer, the term of this patent is extended or adjusted under 35 U.S.C. 154(b) by 814 days.

(21) Appl. No.: 17/051,901

(22) PCT Filed: May 15, 2019

(86) PCT No.: PCT/EP2019/062484
§ 371 (c)(1),
(2) Date: Oct. 30, 2020

(87) PCT Pub. No.: WO2019/224072
PCT Pub. Date: Nov. 28, 2019

(65) Prior Publication Data

US 2021/0227874 A1 Jul. 29, 2021

(30) Foreign Application Priority Data

May 21, 2018 (EP) ..... 18173398
May 21, 2018 (EP) ..... 18173404
(Continued)

(51) Int. Cl.
*A24C 5/01* (2020.01)
*A24C 5/60* (2006.01)
*A24D 1/20* (2020.01)

(52) U.S. Cl.
CPC ..... *A24C 5/01* (2020.01); *A24C 5/60* (2013.01); *A24D 1/20* (2020.01)

(58) Field of Classification Search
CPC ..... A24B 15/167; A24B 15/165; A24C 5/01; A24C 5/352
See application file for complete search history.

(56) References Cited

U.S. PATENT DOCUMENTS 5,065,776 A 11/1991 Lawson et al.
5,271,419 A 12/1993 Arzonico et al.
(Continued)

FOREIGN PATENT DOCUMENTS

CN 105768240 A 7/2016
CN 107750127 A 3/2018
(Continued)

OTHER PUBLICATIONS

International Search Report for Application No. PCT/EP2019/062484 mailed Sep. 11, 2019, 2 pages.
(Continued)

*Primary Examiner* — Michael H. Wilson
*Assistant Examiner* — Stephanie Lynn Moore
(74) *Attorney, Agent, or Firm* — Lerner David LLP

(57) ABSTRACT

A method for manufacturing cylindrical inductively heatable aerosol generating articles includes: (i) supplying a plurality of cylindrical aerosol generating articles to a plurality of first receiving portions of a first transfer unit; (ii) supplying a plurality of inductively heatable susceptor elements to a second receiving portion of a second unit; (iii) aligning a longitudinal direction of the first receiving portions and a longitudinal direction of the second receiving portion; and (iv) sequentially positioning one of the inductively heatable susceptor elements in each of the cylindrical aerosol generating articles by sequentially moving each of the cylindrical aerosol generating articles supplied to the first receiving portions and the inductively heatable susceptor elements supplied to the second receiving portion relative to each
(Continued)

other. An apparatus for performing the method is also described.

18 Claims, 9 Drawing Sheets

(30) Foreign Application Priority Data

| | | |
|---|---|---|
| May 21, 2018 | (EP) | 18173406 |
| Jun. 8, 2018 | (EP) | 18176708 |
| Jun. 8, 2018 | (WO) | PCT/EP2018/065155 |
| Nov. 29, 2018 | (EP) | 18209126 |

(56) References Cited

U.S. PATENT DOCUMENTS

| | | | | |
|---|---|---|---|---|
| 6,158,194 | A | 12/2000 | Horn et al. | |
| 10,645,972 | B2 | 5/2020 | Batista | |
| 2008/0092912 | A1 | 4/2008 | Robinson et al. | |
| 2012/0157278 | A1 | 6/2012 | Cieslikowski et al. | |
| 2015/0068376 | A1 | 3/2015 | Boleslawski | |
| 2015/0282525 | A1 | 10/2015 | Plojoux et al. | |
| 2015/0289565 | A1* | 10/2015 | Cadieux | A24F 40/70 131/328 |
| 2017/0027233 | A1 | 2/2017 | Mironov | |
| 2017/0055574 | A1 | 3/2017 | Kaufman et al. | |
| 2017/0079326 | A1 | 3/2017 | Mironov | |
| 2017/0086508 | A1 | 3/2017 | Mironov et al. | |
| 2017/0119046 | A1 | 5/2017 | Kaufman et al. | |
| 2017/0119054 | A1 | 5/2017 | Zinovik et al. | |
| 2017/0340015 | A1 | 11/2017 | Thorens | |
| 2017/0340016 | A1 | 11/2017 | Thorens | |
| 2017/0340017 | A1 | 11/2017 | Thorens | |
| 2017/0360102 | A1 | 12/2017 | Li et al. | |
| 2018/0303151 | A1 | 10/2018 | Klipfel | |
| 2018/0310622 | A1 | 11/2018 | Mironov et al. | |
| 2018/0352855 | A1* | 12/2018 | Prestia | A24D 1/002 |
| 2018/0360098 | A1 | 12/2018 | Martel | |
| 2019/0152627 | A1* | 5/2019 | Ghiotti | A24C 5/01 |
| 2019/0208813 | A1 | 7/2019 | Rojo-Calderon et al. | |
| 2019/0230988 | A1 | 8/2019 | Aoun | |
| 2020/0060340 | A1 | 2/2020 | Hejazi et al. | |
| 2020/0107572 | A1 | 4/2020 | Marques Borges et al. | |
| 2020/0128880 | A1 | 4/2020 | Gage et al. | |
| 2020/0170298 | A1 | 6/2020 | Lee et al. | |
| 2023/0165301 | A1 | 6/2023 | Batista et al. | |

FOREIGN PATENT DOCUMENTS

| | | | |
|---|---|---|---|
| CN | 108135266 | A | 6/2018 |
| EP | 3075266 | A1 | 10/2016 |
| JP | H0236997 | A | 2/1990 |
| JP | 2007312601 | A | 12/2007 |
| JP | 2011505818 | A | 3/2011 |
| JP | 2015512258 | A | 4/2015 |
| JP | 201770297 | A | 4/2017 |
| JP | 2018529323 | A | 10/2018 |
| JP | 2018531587 | A | 11/2018 |
| TW | 201609005 | A | 3/2016 |
| TW | 201720318 | A | 6/2017 |
| WO | 2011122971 | A2 | 10/2011 |
| WO | 2016184930 | A1 | 11/2016 |
| WO | 2016184977 | A1 | 11/2016 |
| WO | 2017/051350 | A2 | 3/2017 |
| WO | 2017036954 | A1 | 3/2017 |
| WO | 2017072144 | A1 | 5/2017 |
| WO | 2017114959 | A1 | 7/2017 |
| WO | 2017182485 | A1 | 10/2017 |
| WO | 2018162514 | A1 | 9/2018 |

OTHER PUBLICATIONS

Search Report dated Aug. 21, 2022 from Office Action for Taiwanese Application No. 108117046 issued Aug. 25, 2022, 1 Page.

Search Report dated Dec. 19, 2022 from Office Action for Taiwanese Application No. 108117045 issued Dec. 20, 2022, pp. 1-2.

Verfahren und Vorrichtung zur Herstellung von Segmenten der Tabak verarbeitenden Industrie, Prior Art Journal, pp. 59-60, Jun. 1, 2017. 4 pgs. (See Decision of Rejection for Chinese Application No. 201980032747.6 dated Jul. 10, 23 for concise explanation of relevance).

Search Report dated Jun. 26, 2023 from the Office Action for Chinese Application No. 201980077035.6 issued Jun. 29, 2023, pp. 1-3.

Decision of Rejection for Chinese Application No. 201980032747.6 dated Jul. 10, 2023. 14 pgs.

* cited by examiner

METHOD AND APPARATUS FOR MANUFACTURING AEROSOL GENERATING ARTICLES

CROSS-REFERENCE TO RELATED APPLICATIONS

The present application is a national phase entry under 35 U.S.C. § 371 of International Application No. PCT/EP2019/062484, filed May 15, 2019, published in English, which claims priority to European Application No. 18173406.2 filed May 21, 2018, European Application No. 18173398.1 filed May 21, 2018, European Application No. 18173404.7 filed May 21, 2018, International Application No. PCT/EP2018/065155 filed Jun. 8, 2018, European Application No. 18176708.8 filed Jun. 8, 2018, and European Application No. 18209126.4 filed Nov. 29, 2018, the disclosures of which are incorporated herein by reference.

TECHNICAL FIELD

The present disclosure relates generally to aerosol generating articles, and more particularly to an aerosol generating article for use with an aerosol generating device for heating the aerosol generating article to generate an aerosol for inhalation by a user. Embodiments of the present disclosure relate in particular to a method for manufacturing cylindrical inductively heatable aerosol generating articles and/or to an apparatus for manufacturing cylindrical inductively heatable aerosol generating articles.

TECHNICAL BACKGROUND

Devices which heat, rather than burn, an aerosol generating material to produce an aerosol for inhalation have become popular with consumers in recent years.

Such devices can use one of a number of different approaches to provide heat to the aerosol generating material. One such approach is to provide an aerosol generating device which employs an induction heating system. In such a device, an induction coil is provided with the device and a susceptor is provided typically with the aerosol generating material. Electrical energy is supplied to the induction coil when a user activates the device which in turn generates an alternating electromagnetic field. The susceptor couples with the electromagnetic field and generates heat which is transferred, for example by conduction, to the aerosol generating material and an aerosol is generated as the aerosol generating material is heated.

It can be convenient to provide the aerosol generating material in the form of an aerosol generating article which can be inserted by a user into an aerosol generating device. As such, there is a need to provide methods and apparatus which facilitate the manufacture of aerosol generating articles.

SUMMARY OF THE DISCLOSURE

According to a first aspect of the present disclosure, there is provided a method for manufacturing cylindrical inductively heatable aerosol generating articles, the method comprising:

(i) supplying a plurality of cylindrical aerosol generating articles to a plurality of first receiving portions of a first transfer unit;

(ii) supplying a plurality of inductively heatable susceptor elements to a second receiving portion of a second unit;

(iii) aligning a longitudinal direction of the first receiving portions and a longitudinal direction of the second receiving portion;

(iv) sequentially positioning one of said inductively heatable susceptor elements in each of said cylindrical aerosol generating articles by sequentially moving each of the cylindrical aerosol generating articles supplied to the first receiving portions and the inductively heatable susceptor elements supplied to the second receiving portion relative to each other.

Step (i) may comprise sequentially supplying the plurality of cylindrical aerosol generating articles to the plurality of first receiving portions of the first transfer unit.

Step (ii) may comprise sequentially supplying the plurality of inductively heatable susceptor elements to the second receiving portion of the second unit.

Step (iii) may comprise sequentially aligning the longitudinal direction of the first receiving portions and the longitudinal direction of the second receiving portion.

Step (iv) may comprise sequentially positioning one of said inductively heatable susceptor elements in each of said cylindrical aerosol generating articles by sequentially moving each of the cylindrical aerosol generating articles supplied to the first receiving portions and the inductively heatable susceptor elements supplied to the second receiving portion relative to each other after or during movement of both the first transfer unit receiving the cylindrical aerosol generating articles and the second unit receiving the inductively heatable susceptor elements towards the same direction along a first path. With this arrangement, positioning of an inductively heatable susceptor element in an aerosol generating article occurs after movement of both the first transfer unit and the second unit have commenced. This means that step (iii) is performed during transfer of the material, thereby increasing the efficiency of the manufacturing process.

According to a second aspect of the present disclosure, there is provided an apparatus for manufacturing cylindrical inductively heatable aerosol generating articles, the apparatus comprising:

a first transfer unit including a plurality of first receiving portions each for receiving a cylindrical aerosol generating article;

a second unit including a second receiving portion for receiving a plurality of inductively heatable susceptor elements;

a first supply unit for continuously supplying a plurality of the aerosol generating articles to the first receiving portions;

a second supply unit for continuously and sequentially supplying a plurality of the inductively heatable susceptor elements to the second receiving portion; and a positioning unit for sequentially positioning one of said inductively heatable susceptor elements in each of said cylindrical aerosol generating articles by sequentially moving each of the cylindrical aerosol generating articles supplied to the first receiving portions and the inductively heatable susceptor elements supplied to the second receiving portion relative to each other.

The aerosol generating articles typically include an aerosol generating material and are for use with an aerosol generating device for heating the aerosol generating material, without burning the aerosol generating material, to volatise at least one component of the aerosol generating material and thereby generate a vapour or aerosol for inhalation by a user of the aerosol generating device.

In general terms, a vapour is a substance in the gas phase at a temperature lower than its critical temperature, which means that the vapour can be condensed to a liquid by increasing its pressure without reducing the temperature, whereas an aerosol is a suspension of fine solid particles or liquid droplets, in air or another gas. It should, however, be noted that the terms 'aerosol' and 'vapour' may be used interchangeably in this specification, particularly with regard to the form of the inhalable medium that is generated for inhalation by a user.

The method and apparatus according to the present disclosure facilitate the manufacture of aerosol generating articles and in particular enable aerosol generating articles to be mass produced with relative ease.

The first receiving portions may be formed on a surface of the first transfer unit and step (i) may comprise supplying the cylindrical aerosol generating articles to the plurality of first receiving portions in a direction perpendicular to the longitudinal direction of the first receiving portions. The cylindrical aerosol generating articles are easily supplied to, and positioned in, the first receiving portions.

The first receiving portions may comprise a plurality of grooves and step (i) may comprise supplying the cylindrical aerosol generating articles from an upper side of the grooves. Positioning of the aerosol generating articles in the grooves can be readily achieved.

The first transfer unit may transfer the cylindrical aerosol generating articles along a first path. The first path may include a curved path and at least part of the curved path may be circular. Transferring the cylindrical aerosol generating articles along a curved path may enable the use of a relatively compact first transfer unit.

The second unit may transfer the inductively heatable susceptor elements along at least part or the whole of the first path. Transferring the inductively heatable susceptor elements along the same first path as the cylindrical aerosol generating articles may allow the structure of the first transfer unit and the second unit to be simplified and may further facilitate the use of relatively compact units.

Step (iv) may be conducted whilst the cylindrical aerosol generating articles and the inductively heatable susceptor elements are transferred along the same first path, e.g. the same curved path, as the second unit. This may help to maximise the speed of manufacture.

The method may further comprise:

(v) removing the cylindrical inductively heatable aerosol generating articles with the inductively heatable susceptor elements positioned therein from the first transfer unit or the second unit.

Step (v) may be conducted by moving the cylindrical inductively heatable aerosol generating articles in a direction perpendicular to the longitudinal direction of the first receiving portions. Effective removal of the cylindrical inductively heatable aerosol generating articles from the first transfer unit or the second unit is thereby assured.

Step (v) may be performed by a suction mechanism formed in a removal groove arranged on an outer surface of a rotating removal drum. During step (v), the removal groove may cover an exposed part of an aerosol generating article, for example following release of the aerosol generating article by a retaining mechanism (discussed below), and the suction mechanism may secure the aerosol generating article in the removal groove by a suction or vacuum effect. Rotation of the removal drum, and hence of the removal groove with the aerosol generating article secured therein by the suction mechanism, removes the cylindrical inductively heatable aerosol generating article from the first transfer unit or the second unit.

The first supply unit may include a hopper. The use of a hopper provides a simple arrangement for continuously and sequentially supplying the aerosol generating articles to the first receiving portions of the first transfer unit.

The first transfer unit and the second unit may be integrally formed and a longitudinal direction of the second receiving portion may be aligned with a longitudinal direction of the first receiving portions. Correct alignment between the first and second receiving portions is assured because the first transfer unit and the second unit are integrally formed. The structure of the first transfer unit and the second unit, and hence of the manufacturing apparatus, may also be simplified and may allow the use of relatively compact units.

The first receiving portions and/or the second receiving portion may comprise a retaining mechanism respectively to retain the cylindrical aerosol generating articles in the first receiving portions and/or to retain the inductively heatable susceptor element in the second receiving portion. The retaining mechanism could, for example, comprise a suction mechanism or pressing members that engage the cylindrical aerosol generating articles and/or the inductively heatable susceptor element. Retention of the cylindrical aerosol generating articles and/or the inductively heatable susceptor element in the correct position in the first receiving portions and/or the second receiving portion is thereby assured, whereby positioning of the inductively heatable susceptor elements in the cylindrical aerosol generating articles is also assured.

The positioning unit may include a movement mechanism to move the cylindrical aerosol generating articles and/or the inductively heatable susceptor element relative to each other. The movement mechanism may, for example, comprise a pusher mechanism. Relative movement of the cylindrical aerosol generating articles and/or the inductively heatable susceptor element can be achieved in a simple and effective manner.

The apparatus may further comprise a guide for guiding the movement of the cylindrical aerosol generating articles and/or the inductively heatable susceptor elements. The use of a guide ensures that the inductively heatable susceptor elements are correctly positioned in the cylindrical aerosol generating articles.

The first transfer unit may be a drum and the first receiving portions may be formed around an outer surface of the drum such that a longitudinal direction of the first receiving portions is parallel with a rotational axis of the drum. The use of a drum allows the curved path to be easily implemented and enables the use of a relatively compact first transfer unit.

The first transfer unit may comprise a first drum, the second unit may comprise a second drum, and the first and second drums may be configured to rotate in synchronisation with each other.

Each of the plurality of aerosol generating articles may comprise aerosol generating material, for example having first and second regions. The first region may be located upstream of the second region relative to an aerosol flow direction within the article. The first region may alternatively be located downstream of the second region relative to an aerosol flow direction within the article.

Step (iv) may comprise positioning, preferably sequentially, one of said inductively heatable susceptor elements in the first region of each of said aerosol generating articles.

The aerosol generating material may have a first end and a second end and may have an intermediate point between the first and second ends.

In embodiments in which the first region is located upstream of the second region, the first region may extend from the first end to the intermediate point. The second region may extend from the intermediate point to the second end. Each inductively heatable susceptor element may include an elongate part. Step (iv) may comprise positioning, preferably sequentially, one of said inductively heatable susceptor elements in the first region of each of said aerosol generating articles so that it extends from the first end to the intermediate point.

In embodiments in which the first region is located downstream of the second region, the first region may extend from the second end to the intermediate point. The second region may extend from the intermediate point to the first end. Each inductively heatable susceptor element may include an elongate part. Step (iv) may comprise positioning, preferably sequentially, one of said inductively heatable susceptor elements in the first region of each of said aerosol generating articles so that it extends from the second end to the intermediate point.

Step (iv) may comprise sequentially positioning one of said inductively heatable susceptor elements in each of said cylindrical aerosol generating articles by inserting the inductively heatable susceptor element into the first region from the first end or the second end so that it extends to the intermediate point and supporting the aerosol generating material at the opposite one of the first and second ends, for example by a support member, during insertion of the inductively heatable susceptor element into the first region. Supporting the aerosol generating material during insertion of the inductively heatable susceptor element, for example by the support member, may ensure that the aerosol generating material is adequately supported and not displaced by the inductively heatable susceptor element as it is inserted into the aerosol generating material.

The support member may be an external support member, for example part of a manufacturing apparatus. Step (iv) may comprise supporting the aerosol generating material at the first end or the second end by the external support member and may comprise inserting the inductively heatable susceptor element into the first region from the first end or the second end prior to assembling the aerosol generating material with other component parts of the aerosol generating article. With this arrangement, the first end or the second end of the aerosol generating material is supported directly by the external support member. This allows other component parts of the aerosol generating article, such as a filter, to be combined with the aerosol generating material after insertion of the inductively heatable susceptor element into the first region, thereby allowing greater freedom in the design and construction of the aerosol generating article.

The support member may be an integral support member provided by a component part of the aerosol generating article, for example a filter. The method may comprise inserting the inductively heatable susceptor element into the first region from the first end or the second end after assembling the aerosol generating material and the component part intended as the integral support member. With this arrangement, the aerosol generating material is supported at the first end or the second end by the integral support member during insertion of the inductively heatable susceptor element into the first region from the opposite one of the first end or the second end. The manufacturing apparatus and method can be simplified because the need for an external support member is avoided.

Step (iv) may comprise sequentially positioning one of said inductively heatable susceptor elements in each of said cylindrical aerosol generating articles by inserting the inductively heatable susceptor element into the first region from the first end or the second end so that it extends to the intermediate point and may comprise compressing the aerosol generating material in the second region, i.e. between the intermediate point and the other of the first and second ends from which the inductively heatable susceptor element is not inserted, during step (iv) in a direction perpendicular to an axis of the aerosol generating material or the direction of the insertion during insertion of the inductively heatable susceptor element into the first region. The act of compressing the aerosol generating material in the second region during insertion of the inductively heatable susceptor element into the first region ensures that the aerosol generating material is adequately supported and not displaced during insertion of the inductively heatable susceptor element.

Step (i) may comprise sequentially supplying aerosol generating material to the plurality of first receiving portions of the first transfer unit. Each first receiving portion may have a first receiving section that does not compress the aerosol generating material in the first region and may have a second receiving section that compresses the aerosol generating material in the second region. The method may comprise sequentially supporting the aerosol generating material in each first receiving portion by a support drum. The use of a first transfer unit in which each first receiving portion has first (non-compression) and second (compression) receiving sections, in combination with an optional support drum, provides a convenient way to compress the aerosol generating material in the second region.

Each of the inductively heatable susceptor elements may extend in a direction substantially parallel to a longitudinal direction of each of the aerosol generating articles. With this arrangement, air flow resistance through the aerosol generating articles is minimised.

The inductively heatable susceptor element may be tubular. Step (iv) may comprise positioning, preferably sequentially, one of said tubular inductively heatable susceptor elements in the first region of each of said aerosol generating articles so that the aerosol generating material in the first region is positioned both inside and outside of the tubular inductively heatable susceptor element. The use of a tubular inductively heatable susceptor element ensures that heat is generated effectively in the first region because the tubular shape of the susceptor element provides a closed circular electrical path which is suitable for generating eddy currents. Further, positioning the aerosol generating material both inside and outside of the tubular inductively heatable susceptor element optimises aerosol generation and improves energy efficiency as the susceptor element is surrounded by the aerosol generating material.

In embodiments in which the inductively heatable susceptor element is tubular, the movement mechanism, for example the pusher mechanism, may have a tapered part, for example a tapered end, which can be partially inserted into an end of the tubular inductively heatable susceptor element. The tapered part may have an external diameter which corresponds to an internal diameter of the tubular inductively heatable susceptor element. Correct insertion of the tubular inductively heatable susceptor element into the first region is thereby assured by the movement mechanism.

The inductively heatable susceptor element may include a sharpened or pointed end and may possibly include a plurality of sharpened or pointed ends. Step (iv) may comprise positioning one of said inductively heatable susceptor elements in each of said aerosol generating articles so that the or each sharpened or pointed end is positioned at the intermediate point of the aerosol generating material. The provision of an inductively heatable susceptor element with a sharpened or pointed end allows the inductively heatable susceptor element to be easily positioned in the aerosol generating material, for example by being inserted into the aerosol generating material from the first end or the second end, during manufacture of the aerosol generating article.

In some embodiments, the sharpened or pointed end may have a surface area of less than 1 $mm^2$. The surface area could be less than 0.5 $mm^2$ and is typically less than 0.25 $mm^2$. A small surface area facilitates insertion of the inductively heatable susceptor element into the aerosol generating material during manufacture of the aerosol generating article.

The inductively heatable susceptor element may comprise a flat part. The flat part may be positioned at the first end of the aerosol generating material during step (iv) in embodiments in which the first region is upstream of the second region. The flat part may be positioned at the second end of the aerosol generating material during step (iv) in embodiments in which the first region is downstream of the second region. The flat part may have a projected or an encompassed area of greater than 1 $mm^2$, preferably greater than 2 $mm^2$, and less than a cross-sectional area of the aerosol generating article. In some embodiments, the projected or encompassed area of the flat part may be greater than the surface area of the flat part. In one example, the inductively heatable susceptor element may be tubular and may have an annular flat part. The surface area of the flat part corresponds the annular area and the projected or encompassed area corresponds to the circular area bounded by the outer periphery of the tubular inductively heatable susceptor element, wherein the circular area is greater than the annular area. It will be understood by one of ordinary skill in the art that other shapes of inductively heatable susceptor element can be employed in which the projected or encompassed area of the flat part is greater than the surface area of the flat part. The provision of a flat part may allow the inductively heatable susceptor element to be more easily manipulated and inserted into the aerosol generating material from the first end or the second end with the correct orientation such as angle.

By way of non-limiting example, each inductively heatable susceptor element may be U-shaped, E-shaped or I-shaped. It will be understood that U-shaped and E-shaped inductively heatable susceptor elements are examples of inductively heatable susceptor elements including both a flat part and a plurality of sharpened or pointed ends at an opposite end of the inductively heatable susceptor element.

Each inductively heatable susceptor element may be connected to a sharpened or pointed part comprising a non-inductively heatable material. The non-inductively heatable material may comprise a material which is substantially non-electrically conductive and non-magnetically permeable. With this arrangement, it will be understood that heat is not generated in the sharpened or pointed part. The ease of manufacture of the sharpened or pointed part may be improved due to the use of a non-inductively heatable material, for example a plastics material or a ceramic material which is resistant to high temperatures.

In one embodiment, each inductively heatable susceptor element may be connected at one end to a sharpened or pointed part comprising a non-inductively heatable material.

In another embodiment, the sharpened or pointed part may include a connector, such as a tubular connector, and each inductively heatable susceptor element may be connected to the connector. The provision of a connector may facilitate connection of the sharpened or pointed part and the inductively heatable susceptor element.

In a first example, a tubular inductively heatable susceptor element may be positioned around a tubular connector and may form a sleeve which surrounds, and is connected to, the tubular connector. This arrangement may allow the sharpened or pointed end and the inductively heatable susceptor element to be connected with relative ease.

In a second example, the inductively heatable susceptor element may comprise a coating of inductively heatable material applied to the connector.

Step (iv) may comprise positioning one of said inductively heatable susceptor elements in each of said aerosol generating articles so that an end of each inductively heatable susceptor element, for example the flat part, is flush with the first end of the aerosol generating material in embodiments in which the first region is upstream of the second region. Step (iv) may comprise positioning one of said inductively heatable susceptor elements in each of said aerosol generating articles so that an end of each inductively heatable susceptor element, for example the flat part, is flush with the second end of the aerosol generating material in embodiments in which the first region is downstream of the second region. Step (iv) may alternatively comprise positioning one of said inductively heatable susceptor elements in each of said aerosol generating articles so that an end of each inductively heatable susceptor element, for example the flat part, is embedded in the first end or the second end of the aerosol generating material. Embedding the end of the inductively heatable susceptor element in the aerosol generating material may allow an aerosol or vapour to be generated more effectively because the whole of the inductively heatable susceptor element is surrounded by aerosol generating material and, therefore, heat transfer from the inductively heatable susceptor element to the aerosol generating material is maximised.

The inductively heatable susceptor element may have a length which may be greater than a width of the aerosol generating article. The resulting aerosol generating article may have a shape that is optimised for insertion into a cavity of an aerosol generating device.

The aerosol generating article may be wrapped by a sheet of material. More particularly, the method may comprise, after step (iv) and possibly after step (v), combining the aerosol generating article with a filter and wrapping the aerosol generating article and the filter with a sheet of material. In some embodiments, the method may comprise, after step (iv) and possibly after step (v), combining the aerosol generating article with a filter and a hollow tubular member positioned between the article and the filter and thereafter wrapping the aerosol generating article, the filter and the hollow tubular member with a sheet of material. The sheet of material thus acts as a wrapper. The wrapper may comprise a material which is substantially non-electrically conductive and non-magnetically permeable and may, for example, comprise a paper wrapper. The use of a wrapper may facilitate manufacture and handing of the aerosol generating article and may enhance aerosol generation.

Each inductively heatable susceptor element may comprise one or more, but not limited, of aluminium, iron, nickel, stainless steel and alloys thereof, e.g. Nickel Chromium or Nickel Copper. With the application of an electromagnetic field in its vicinity, the susceptor element may generate heat due to eddy currents and magnetic hysteresis losses resulting in a conversion of energy from electromagnetic to heat.

The aerosol generating material may be any type of solid or semi-solid material. Example types of aerosol generating material include powder, granules, particles, gel, strips, loose leaves, cut filler, pellets, powder, shreds, strands, foam material and sheets. The aerosol generating material may comprise plant derived material and in particular, may comprise tobacco.

The aerosol generating material may comprise an aerosol-former. Examples of aerosol-formers include polyhydric alcohols and mixtures thereof such as glycerine or propylene glycol. Typically, the aerosol generating material may comprise an aerosol-former content of between approximately 5% and approximately 50% on a dry weight basis. In some embodiments, the aerosol generating material may comprise an aerosol-former content of approximately 15% on a dry weight basis.

DETAILED DESCRIPTION OF EMBODIMENTS

Embodiments of the present disclosure will now be described by way of example only and with reference to the accompanying drawings.

Figure 1:
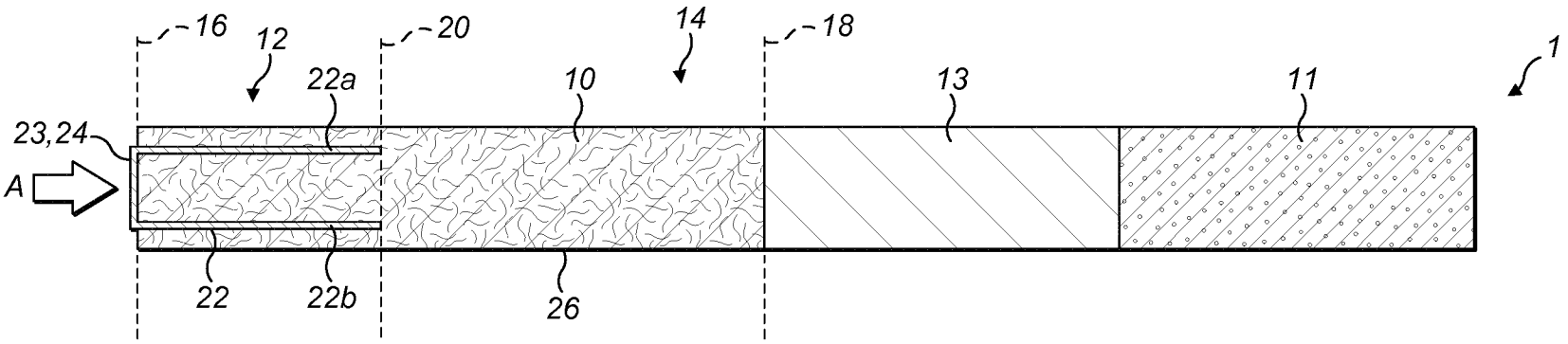
FIG. 1 is diagrammatic cross-sectional side view of on example of a cylindrical inductively heatable aerosol generating article.
Figure 2:
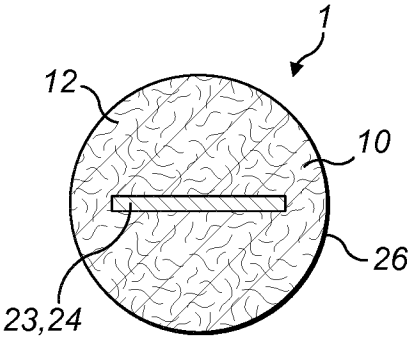
FIG. 2 is a diagrammatic view in the direction of Arrow A shown in FIG. 1.

Referring initially to FIGS. 1 and 2, there is shown an example of an aerosol generating article 1 for use with an aerosol generating device that comprises an induction coil and that operates based on the induction heating principle. Such devices are known in the art and will not be described in further detail in this specification. The aerosol generating article 1 is elongate and substantially cylindrical. The circular cross-section facilitates handling of the article 1 by a user and insertion of the article 1 into a cavity or heating compartment of an aerosol generating device.

The aerosol generating article 1 comprises aerosol generating material 10 having a first region 12 and a second region 14. In the illustrated example, the first region 12 is located upstream of the second region 14 relative to an aerosol flow direction within the article 1. In other embodiments, the first region 12 can be located downstream of the second region 14. The aerosol generating material 10 has a first end 16, a second end 18 and an intermediate point 20 between the first and second ends 16, 18.

The aerosol generating article 1 comprises an optional hollow tubular member 13 positioned downstream of the second region 14 and a filter 11, for example comprising cellulose acetate fibres, positioned downstream of the tubular member 13. The aerosol generating material 10, the optional tubular member 13 and the filter 11 are wrapped by a sheet of material, for example a paper wrapper 26, to maintain the positional relationship between the first and second regions 12, 14 of the aerosol generating material 10, the optional tubular member 13 and the filter 11.

The aerosol generating article 1 comprises an inductively heatable susceptor element 22 which is positioned in the first region 12. The inductively heatable susceptor element 22 is substantially U-shaped, comprising two elongate parts 22*a*, 22*b*, which extend through the first region 12 from the first end 16 to the intermediate point 20, and a connecting part 23 which connects the two elongate parts 22*a*, 22*b*.

The ends of the elongate parts 22*a*, 22*b* can be sharpened or pointed to facilitate insertion of the inductively heatable susceptor element 22 into the first region 12 from the first end 16. The connecting part 23 constitutes a flat part 24 which allows the inductively heatable susceptor element 22 to be easily manipulated and inserted into the first region 12 from the first end 16. In the illustrated example, the end of the inductively heatable susceptor element 22, constituted by the flat part 24, is substantially flush with the first end 16 of the aerosol generating material 10 but it will be appreciated that in other embodiments the end of the inductively heatable susceptor element 22 constituted by the flat part 24 could be embedded in the first end 16 so that the inductively heatable susceptor element 22 is fully surrounded by the aerosol generating material 10 in the first region 12.

The aerosol generating material 10 is typically a solid or semi-solid material. Examples of suitable aerosol forming solids include powder, granules, particles, gel, strips, loose leaves, cut filler, pellets, powder, shreds, strands, foam material and sheets. The aerosol generating material 10 typically comprises plant derived material and, in particular, comprises tobacco.

The aerosol generating material 10 comprises an aerosol-former such as glycerine or propylene glycol. Typically, the aerosol generating material may comprise an aerosol-former content of between approximately 5% and approximately 50% on a dry weight basis. Upon heating, the aerosol generating material 10 releases volatile compounds possibly including nicotine or flavour compounds such as tobacco flavouring.

When a time varying electromagnetic field is applied in the vicinity of the inductively heatable susceptor element 22 during use of the article 1 in an aerosol generating device, heat is generated in the inductively heatable susceptor element 22 due to eddy currents and magnetic hysteresis losses and the heat is transferred from the inductively heatable susceptor element 22 to the aerosol generating material 10 in the first region 12 to heat the aerosol generating material 10 in the first region 12 without burning it and to thereby generate an aerosol. As a user inhales through the filter 11, the heated aerosol is drawn in a downstream direction through the article 1 from the first region 12 and through the second region 14. As the heated aerosol flows through the second region 14 and the optional tubular member 13 towards the filter 11, the heated aerosol cools and condenses to form an aerosol or vapour with suitable characteristics for inhalation by a user through the filter 11. One or more volatile components may be released from the aerosol generating material 10 in the second region 14 as the heated aerosol from the first region 12 flows through it due to heating of the aerosol generating material 10 in the second region 14 by the heated aerosol generated in the first region 12. The release of the one or more volatile compounds from the aerosol generating material 10 in the second region 14 may enhance the characteristics (e.g. flavour) of the vapour or aerosol that is delivered to a user through the filter 11.

Apparatus 30, 60, 80 and methods suitable for manufacturing cylindrical aerosol generating articles, such as the aerosol generating article 1 described above with reference to FIGS. 1 and 2, will now be described.

Figure 3:
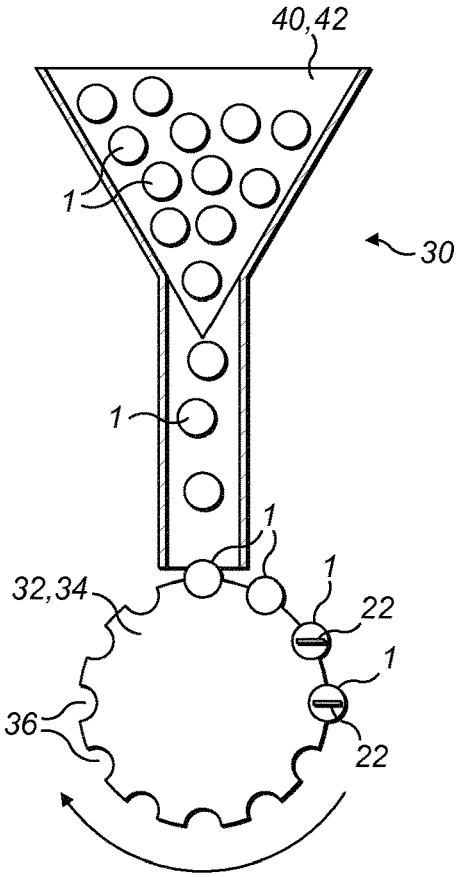
FIGS. 3 and 4 are diagrammatic views of a first embodiment of an apparatus suitable for manufacturing cylindrical inductively heatable aerosol generating articles such as illustrated in FIGS. 1 and 2.
Figure 4:
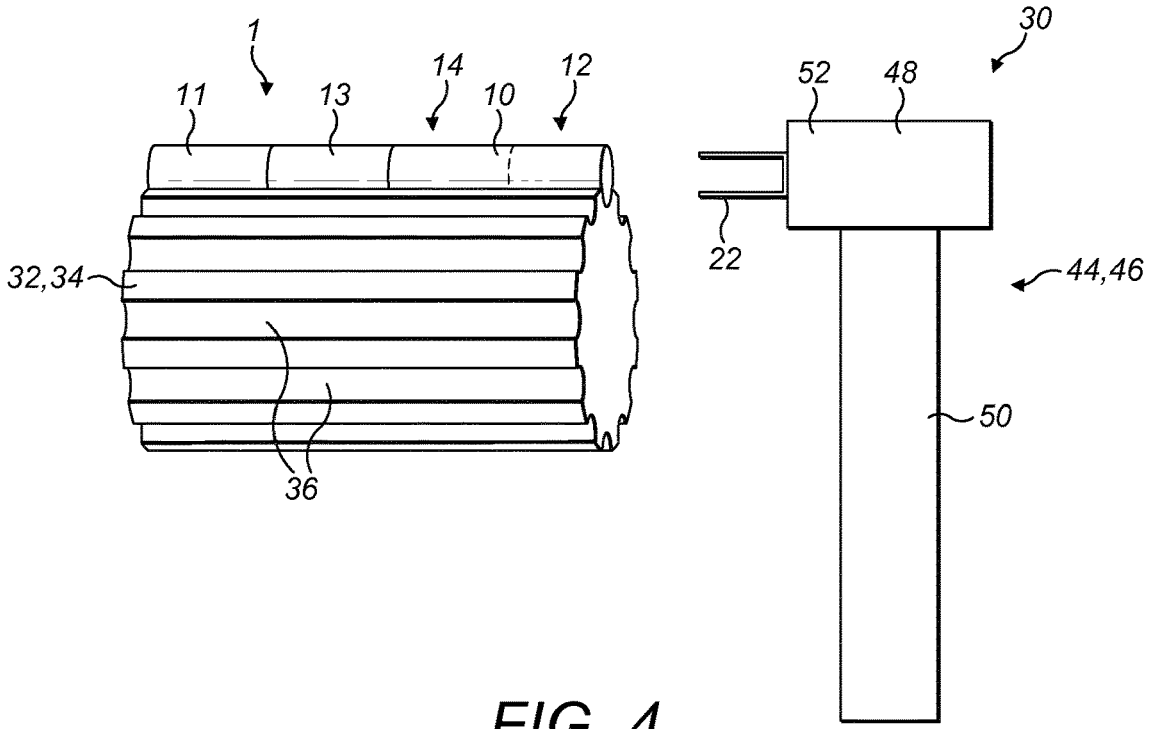

Referring to FIGS. 3 and 4, there is shown a first embodiment of an apparatus 30 for manufacturing cylindrical aerosol generating articles such as the aerosol generating article 1 described above.

The apparatus 30 comprises a first transfer unit 32 in the form of an indexing drum 34 and comprising a plurality of first receiving portions 36 in the form of grooves 38 which are positioned around the outer surface of the drum 34 and which extend in a direction parallel to the rotational axis of the drum 34.

The apparatus 30 comprises a first supply unit 40 in the form of a hopper 42 which contains a plurality of cylindrical aerosol generating articles. The cylindrical aerosol generating articles correspond to the aerosol generating articles 1 described above with reference to FIGS. 1 and 2 prior to insertion of an inductively heatable susceptor element 22 into the first region 12 of the aerosol generating material 10. The cylindrical aerosol generating articles 1 may, therefore, be regarded as partially-formed cylindrical aerosol generating articles 1. In the illustrated embodiment, the hopper 42 is conveniently positioned above the drum 34 and is arranged to continuously and sequentially supply one of the plurality of aerosol generating articles 1 to each of the grooves 38 in a direction that is perpendicular to the longitudinal direction of the grooves 38. It will be understood that the hopper 42 is a stationary component and that the plurality of aerosol generating articles 1 are continuously and sequentially supplied to each of the grooves 38 under the action of gravity and by incrementally rotating the indexing drum 34, for example in a clockwise direction as shown by the arrow in FIG. 3, to position one of the grooves 38 below the hopper 42.

The apparatus 30 includes a second unit 44, for example in the form of an applicator gun 46. The second unit 44 includes a second receiving portion 48 for receiving a plurality of the inductively heatable susceptor elements 22 and a second supply unit 50 which is arranged to continuously and sequentially supply a plurality of the inductively heatable susceptor elements 22 to the second receiving portion 48.

The apparatus 30 further comprises a positioning unit 52, which in the illustrated embodiment forms part of the applicator gun 46, which is arranged to sequentially position one of the inductively heatable susceptor elements 22 in the first region 12 of the aerosol generating material 10 of each of the aerosol generating articles 1. More particularly, the positioning unit 52 is arranged to sequentially insert one of the inductively heatable susceptor elements 22 into the first region 12 of the aerosol generating material 10 from the first end 16, so that each of the inductively heatable susceptor elements 22 extends through the first region 12 of each of the aerosol generating articles 1 as described above with reference to FIGS. 1 and 2.

In use, the indexing drum 34 is rotated incrementally, in the clockwise direction indicated by the arrow in FIG. 3, to sequentially position empty grooves 38 in the drum 34 below the hopper 42. Aerosol generating articles 1 are continuously and sequentially supplied from the hopper 42 to the grooves 38 during the indexed rotation of the drum 34. During rotation of the indexing drum 34, the aerosol generating articles 1 are continuously and sequentially transferred in their respective grooves 38 to a rotational position aligned with the applicator gun 46, and in particular with the positioning unit 52. When an aerosol generating article 1 reaches the rotational position in which it is aligned with the positioning unit 52 of the applicator gun 46, the positioning unit 52 inserts one of the inductively heatable susceptor elements 22 into the aerosol generating material 10 of the article 1, and in particular into the first region 12, from the first end 16 to form a complete aerosol generating article 1. This process is repeated as further partially-formed aerosol generating articles 1 reach the rotational position in alignment with the positioning unit 52.

The complete aerosol generating articles 1 are sequentially removed from the indexing drum 34 at a subsequent rotational position, for example in a direction that is perpendicular to the longitudinal direction of the grooves 38 under the action of gravity or in a direction that is perpendicular to, or parallel with, the longitudinal direction of the grooves 38, for example by a suitable ejector mechanism or a removal drum (not shown).

In a variant of the first embodiment, the apparatus 30 can be configured so that the hopper 42 (or other supply unit) continuously and sequentially supplies a partially-formed aerosol generating article 1 to each of the grooves 64, the partially-formed aerosol generating article 1 comprising aerosol generating material 10 that will form the first and second regions 12, 14 after an inductively heatable susceptor element 22 has been positioned in the aerosol generating material 10.

After the (partially-formed) aerosol generating article 1 has been removed from the groove 64, the filter 11 and optional tubular member 13 are arranged in in abutting coaxial alignment with aerosol generating material 10, and the various components wrapped by a paper wrapper 26, to thereby form a complete and fully assembled aerosol generating article 1 such as described above with reference to FIGS. 1 and 2.

Referring now to FIGS. 5*a* to 5*f*, there is shown a second embodiment of an apparatus 60 for manufacturing cylindrical aerosol generating articles such as the aerosol generating article 1 described above. The apparatus 60 shares some similarities with the apparatus 30 described above with reference to FIGS. 3 and 4 and corresponding elements are designated using the same reference numerals.

The apparatus 60 comprises a first transfer unit 32 and a second unit 44 which are integrally formed as an indexing drum 62.

The first transfer unit 32 comprises a plurality of first receiving portions 36 in the form of grooves 64 which are positioned around the outer surface of the drum 62 and which extend in a direction parallel to the rotational axis of the drum 62. The apparatus 60 further includes a first supply unit (not shown), for example a hopper 42 as described above with reference to FIGS. 3 and 4, positioned above the drum 62 and which is arranged to continuously and sequentially supply a cylindrical aerosol generating article to each of the grooves 64. In the illustrated embodiment, the apparatus 60 is configured so that the hopper 42 (or other supply unit) continuously and sequentially supplies a partially-formed aerosol generating article 1 to each of the grooves 64, the partially-formed aerosol generating article 1 comprising aerosol generating material 10 that will form the first and second regions 12, 14 after an inductively heatable susceptor element 22 has been positioned in the aerosol generating material 10. The apparatus 60 may include a suction mechanism (not shown) or other retaining mechanism to retain partially-formed aerosol generating articles 1 in position in the grooves 64.

The second unit 44 similarly comprises a plurality of second receiving portions 48 in the form of grooves 66 which are aligned with the grooves 64 and which are arranged to continuously and sequentially receive a plurality of the inductively heatable susceptor elements 22. The apparatus 60 further includes a second supply unit (not shown) which is arranged to continuously and sequentially supply an inductively heatable susceptor element 22 to each of the grooves 64. The apparatus 60 may include a suction mechanism (not shown) or other retaining mechanism to retain the inductively heatable susceptor elements 22 in position in the grooves 66.

Figure 5A:
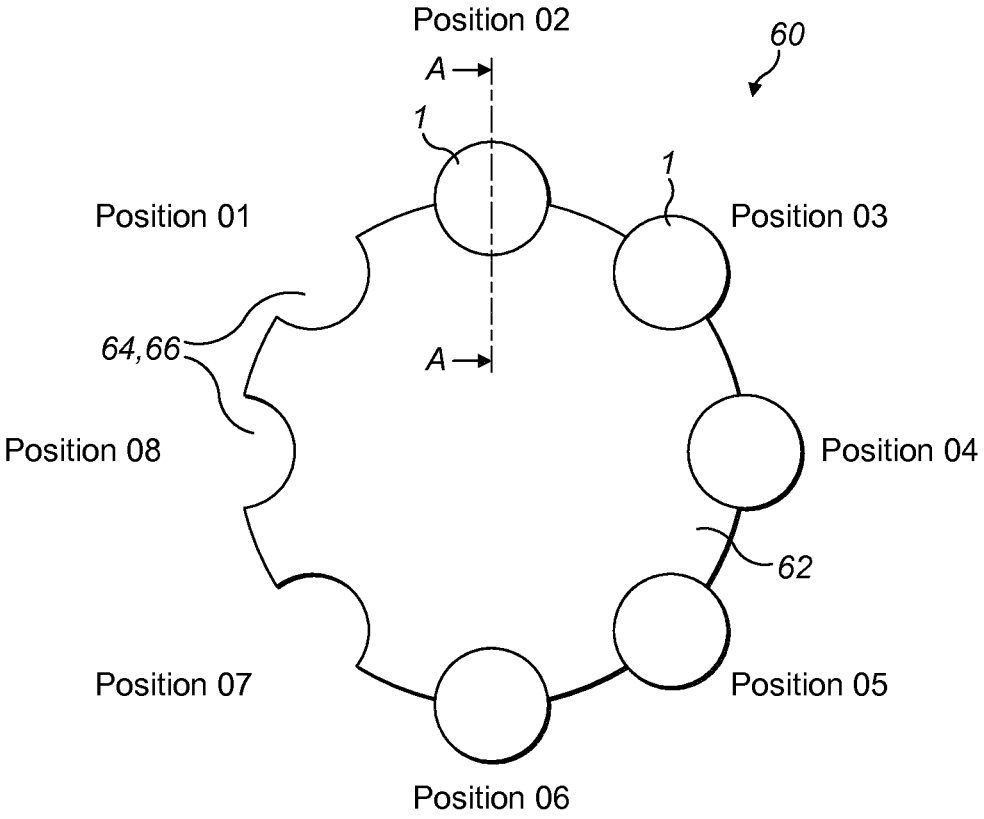
FIGS. 5*a* to 5*f* are schematic illustrations of a second embodiment of an apparatus and method suitable for manufacturing inductively heatable aerosol generating articles such as illustrated in FIGS. 1 and 2.

The apparatus 60 further comprises a positioning unit 52 in the form of a pusher mechanism 68 which is arranged to sequentially position, in combination with a guide 70, one of the inductively heatable susceptor elements 22 in the first region 12 of the aerosol generating material 10 of each of the aerosol generating articles 1. More particularly, and as best seen in FIGS. 5*d* and 5*e*, the pusher mechanism 68 is arranged to sequentially insert one of the inductively heatable susceptor elements 22 into the first region 12 of the aerosol generating material 10 from the first end 16, so that each of the inductively heatable susceptor elements 22 extends through the first region 12 of each of the aerosol generating articles 1 in the manner described above with reference to FIGS. 1 and 2.

In use, the indexing drum 34 is rotated incrementally, in the clockwise direction shown in FIG. 5*a*, through a series of rotational positions 01 to 08 as will now be explained in more detail with reference to FIGS. 5*a* to 5*f*.

Figure 5B:
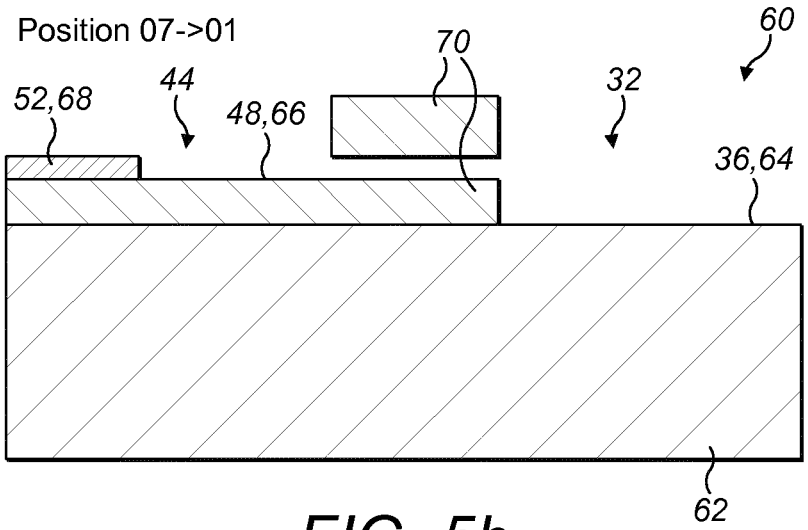

When a set of cooperating grooves 64, 66 in the drum 62 are in rotational positions 01, 07 and 08, it will be seen in FIG. 5*b* that the grooves 64 do not contain cylindrical aerosol generating articles 1 and that the grooves 66 do not contain inductively heatable susceptor elements 22. It will also be noted that the pusher mechanism 68 is in a retracted position.

Figure 5C:
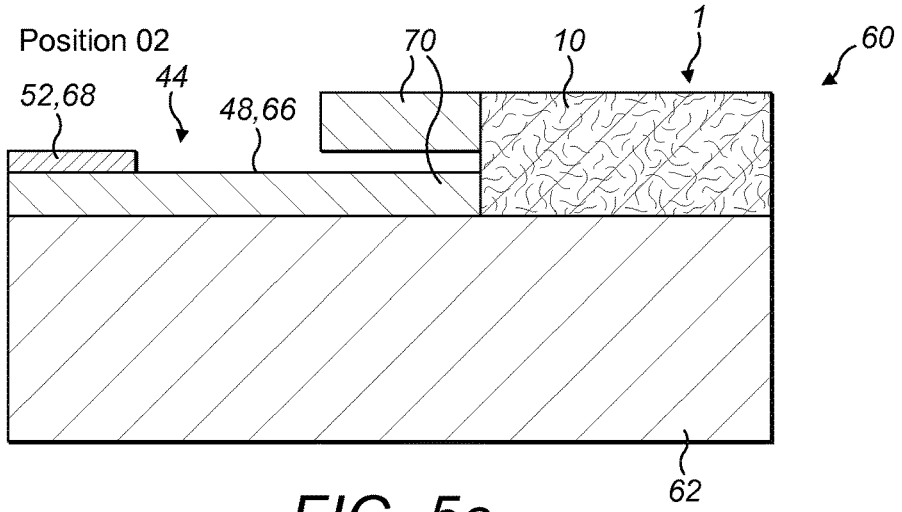
Figure 5D:
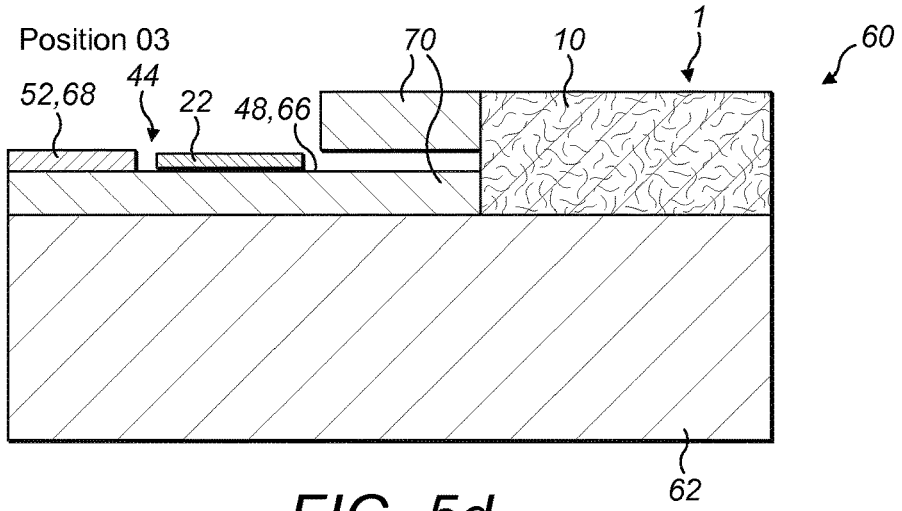
Figure 5E:
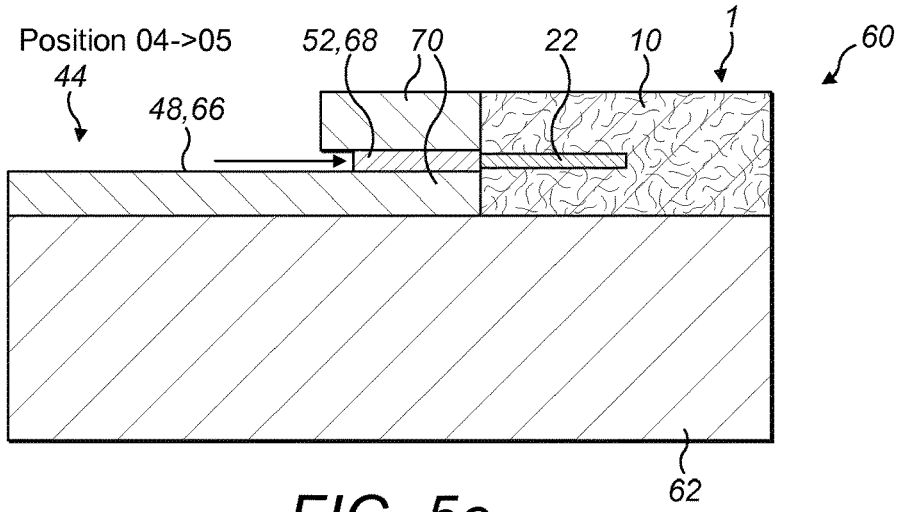
Figure 5F:
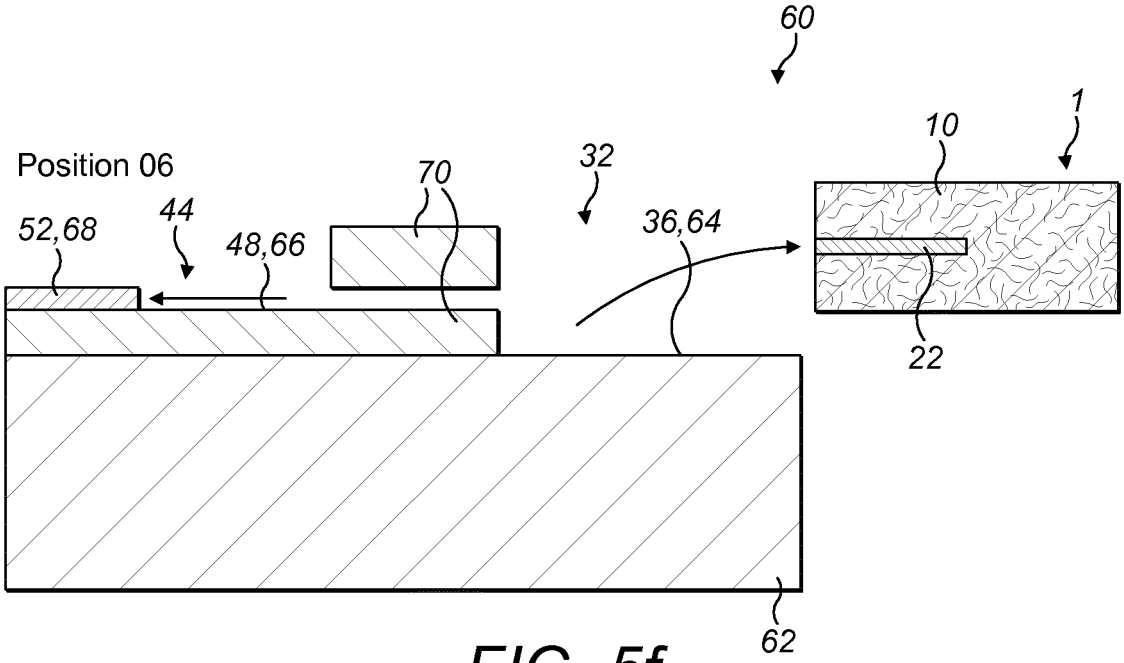

When the drum 62 is rotated to position a set of cooperating grooves 64, 66 in rotational position 02, it will be seen in FIG. 5*c* that aerosol generating material 10, for example constituting a partially-formed cylindrical aerosol generating article 1, is supplied to the groove 64, for example from a hopper 42 as described above. When the drum 62 is further rotated to position the cooperating grooves 64, 66 in rotational position 03, it will be seen in FIG. 5*d* that an inductively heatable susceptor element 22 is supplied to the groove 66 in readiness for being positioned in the aerosol generating material 10 of the aerosol generating article 1 that was positioned in the groove 64 at rotational position 02.

Further indexed rotation of the drum 62 in the clockwise direction moves the set of cooperating grooves to positions 04 and 05. As seen in FIG. 5*c*, as the drum 62 rotates through these positions, the pusher mechanism 68 moves in a direction parallel to the grooves 64, 66 from the retracted position to an extended position. As the pusher mechanism 68 moves from the retracted position to the extended position, it pushes the inductively heatable susceptor element 22 along and out of the groove 66 and into the aerosol generating material 10 of the aerosol generating article 1 positioned in the groove 64 via the first end 16 of the aerosol generating material 10.

During its movement from the retracted position to the extended position, the pusher mechanism 68 and the inductively heatable susceptor element 22 cooperate with the guide 70 to ensure that the inductively heatable susceptor element 22 is correctly positioned in the aerosol generating material 10, for example in a central region of the aerosol generating material 10. The pusher mechanism 68 returns to the retracted position during movement of the indexing drum 62 from rotational position 05 to rotational position 06 and, when the indexing drum 62 reaches rotational position 06, the partially-formed aerosol generating article 1 with inserted inductively heatable susceptor element 22 is removed from the groove 64, for example under the action of gravity or by a suitable ejector mechanism or a removal drum (not shown). Continued rotation of the indexing drum 62 moves the empty grooves 64, 66 through rotational positions 07, 08 and 01 until the grooves 64, 66 are returned to position 02 so that the method described above can be repeated.

After the (partially-formed) aerosol generating article 1 has been removed from the groove 64, the filter 11 and optional tubular member 13 are arranged in in abutting coaxial alignment with aerosol generating material 10, and the various components wrapped by a paper wrapper 26, to thereby form a complete and fully assembled aerosol generating article 1 as described above with reference to FIGS. 1 and 2.

Figure 6:
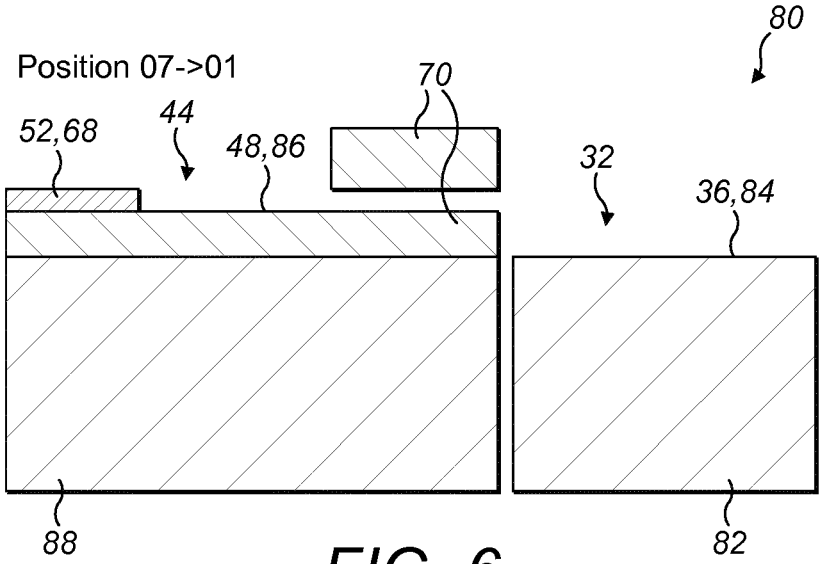
FIG. 6 is a diagrammatic illustration of an alternative apparatus suitable for manufacturing inductively heatable aerosol generating articles such as illustrated in FIGS. 1 and 2.

FIG. 6 illustrates an alternative apparatus 80 which is suitable for implementing the method described above with reference to FIGS. 5*a* to 5*f*. The apparatus 80 is similar to the apparatus 60 described above and corresponding elements are designated using the same reference numerals.

In the apparatus 80, the first transfer unit 32 comprises a first indexing drum 82 having a plurality of first receiving portions 36 in the form of grooves 84 which are positioned around the outer surface of the first drum 82 and which extend in a direction parallel to the rotational axis of the first drum 82.

The second unit 44 comprises a second indexing drum 88 which comprises a plurality of second receiving portions 48 in the form of grooves 86 which are positioned around the outer surface of the second drum 88 and which extend in a direction parallel to the rotational axis of the second drum 88.

The grooves 84 in the first drum 82 are aligned with the grooves 86 in the second drum 88. In order to ensure that the alignment is maintained, the first and second drums 82, 88 are configured to rotate in synchronisation with each other.

Figure 7A:
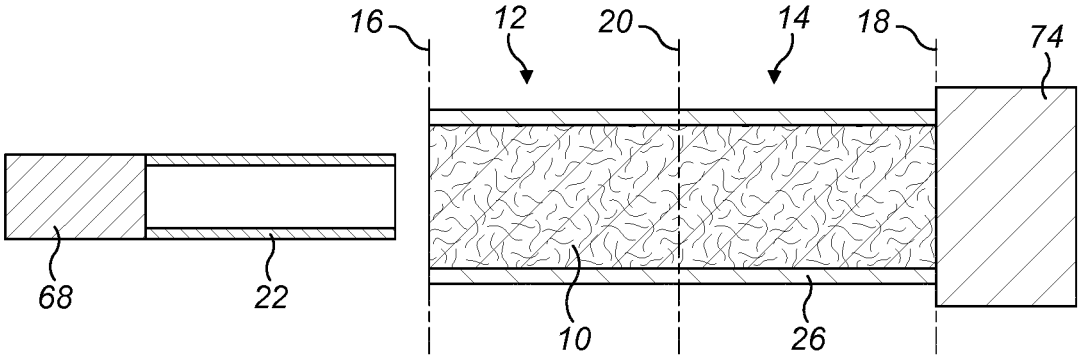
FIGS. 7*a* and 7*b* are diagrammatic illustrations of part of an apparatus suitable for manufacturing inductively heatable aerosol generating articles such as illustrated in FIGS. 1 and 2.
Figure 7B:
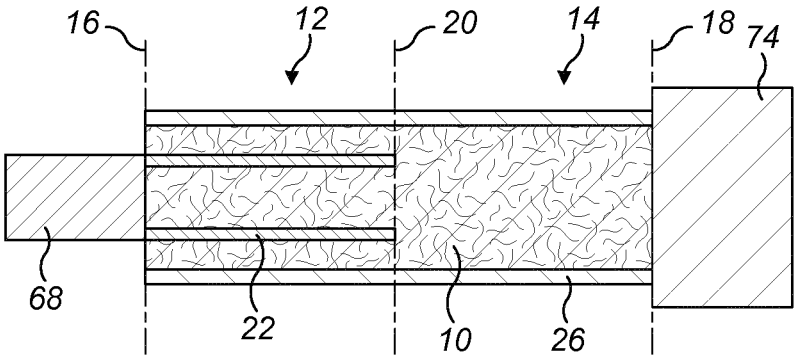

Referring now to FIGS. 7*a* and 7*b*, there is shown part of an apparatus and method which may form part of the apparatus 30, 60, 80 and corresponding methods described above. Once again, corresponding elements are designated using corresponding reference numerals.

In the aerosol generating article 1 illustrated in FIGS. 7*a* and 7*b*, the inductively heatable susceptor element 22 is tubular and in order to position the tubular inductively heatable susceptor element 22 in the first region 12 of the aerosol generating material 10, a pusher mechanism 68 as described above is engaged with an end of the tubular inductively heatable susceptor element 22 and moved towards the aerosol generating material 10 to push the tubular inductively heatable susceptor element 22 into the first region 12 from the first end 16. The aerosol generating material 10 is supported at the second end 18 by an external support member 74, which may form part of the apparatus 30, 60, 80, during insertion of the inductively heatable susceptor element 22 into the first region 12.

Figure 8:
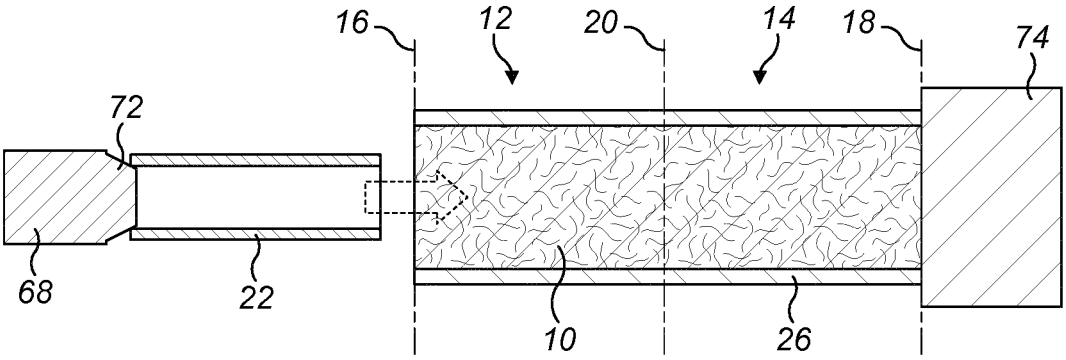
FIG. 8 is a diagrammatic illustration of part of an apparatus similar to that shown in FIGS. 7*a* and 7*b;*

As shown in FIG. 8, the pusher mechanism 68 can advantageously have a tapered end 72 having an external diameter which corresponds to the internal diameter of the tubular inductively heatable susceptor element 22, thus allowing the tapered end 72 to be inserted into the end of the tubular inductively heatable susceptor element 22 and ensuring optimum alignment and cooperation between these two components.

Figure 9A:
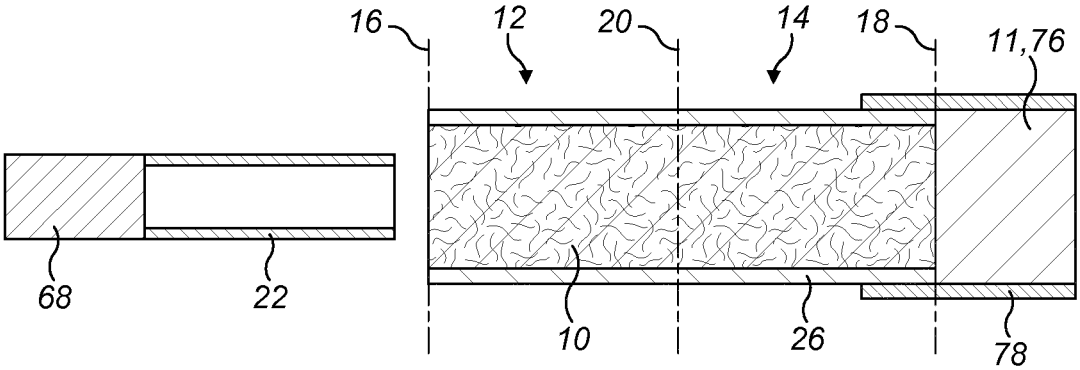
FIGS. 9*a* and 9*b* are diagrammatic illustrations of part of another apparatus and method for manufacturing inductively heatable aerosol generating articles.
Figure 9B:
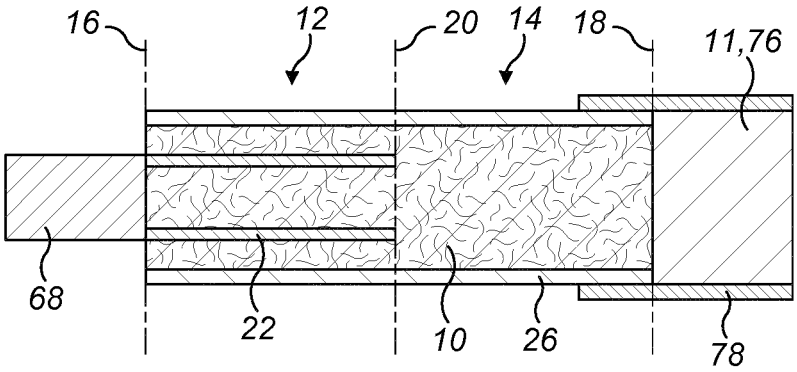
Figure 10:
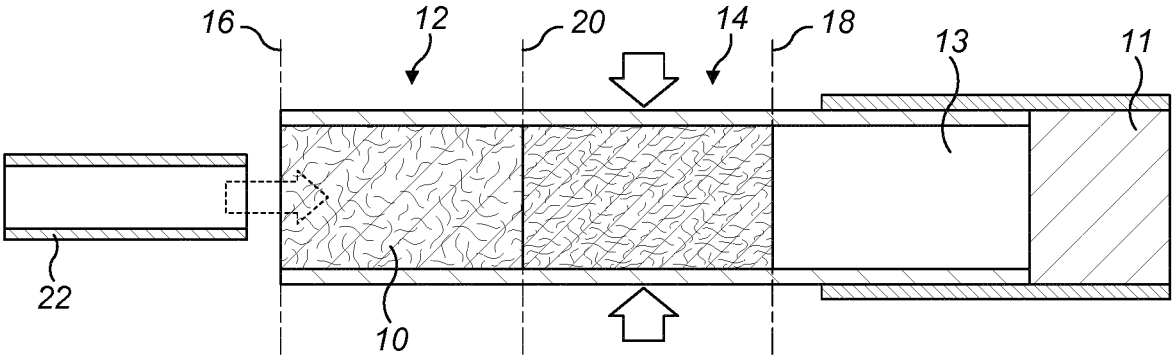
FIGS. 10 and 11 are schematic illustrations of a method and apparatus for manufacturing inductively heatable aerosol generating articles such as illustrated in FIGS. 1 and 2.
Figure 11:
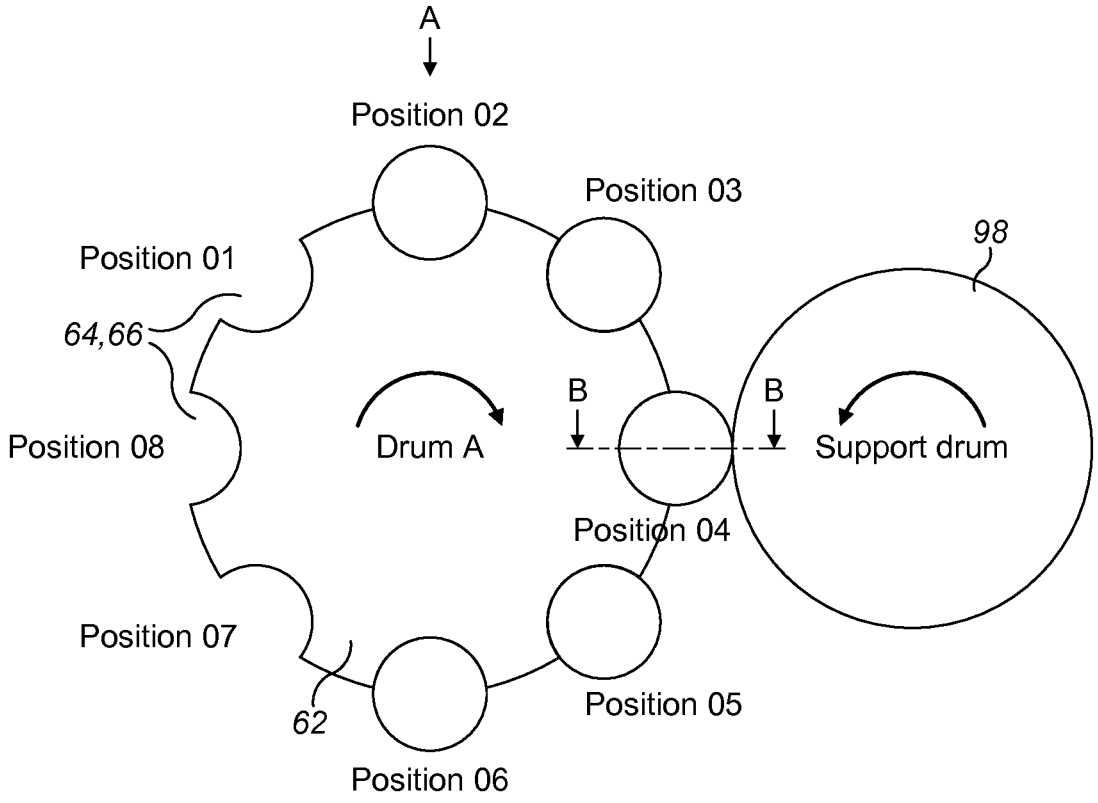

Referring now to FIGS. 9*a* and 9*b*, and in a variation of the embodiments described above with reference to FIGS. 7 and 8, the aerosol generating material 10 can be supported at the second end 18 by an integral support member 76 during insertion of the tubular inductively heatable susceptor element 22 into the first region 12. In the embodiment shown in FIGS. 9*a* and 9*b*, the integral support member 80 is constituted by the filter 11 which is secured to the second end 18 of the aerosol generating material 10, for example by tipping paper 78, prior to insertion of the tubular inductively heatable susceptor 22 into the first region 12 from the first end 16. In this example, it will be noted that the optional hollow tubular member 13 described above with reference to FIGS. 1 and 2 has been omitted to reduce the overall length of the aerosol generating article and to maximise the support provided by the filter 11 during insertion of the inductively heatable susceptor element 22 into the first region 12.

Referring now to FIGS. 10 to 13, there is shown variation of the apparatus 30, 60, 80 and methods described above in which the aerosol generating material 10 in the second region 14 is compressed in a direction (denoted by the arrows in FIG. 10) that is perpendicular to an axis of the aerosol generating material 10 during insertion of the tubular inductively heatable susceptor element 22 into the first region 16.

In more detail, and referring in particular to FIGS. 11 and 12*a* to 12*c* which relate to the apparatus 60, 80 and method described above with reference to FIGS. 5 and 6, each of the grooves 64 formed in the drum 62 comprises a first receiving section 94 which corresponds to the position of the first region 12 of the aerosol generating material 10 and which does not compress the aerosol generating material 10 in the first region 12. Each of the grooves 64 also comprises a second receiving section 96 which corresponds to the position of the second region 14 of the aerosol generating material 10 and which compresses the aerosol generating material 10 in the second region 14 during insertion of the inductively heatable susceptor element 22 into the first region 12 by the pusher mechanism 68. The second receiving section 96 can have any suitable geometry, for example as shown in the non-limiting examples of FIGS. 12*a* to 12*c*.

Figures 12A, 12B, 12C:
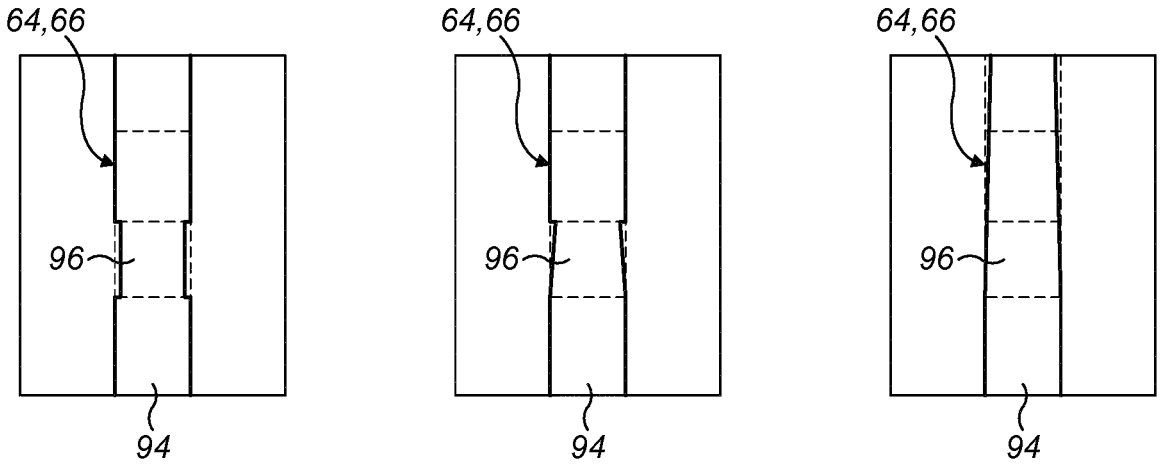
FIGS. 12*a* to 12*c* are views in the direction of arrow A in FIG. 11.
Figure 13A:
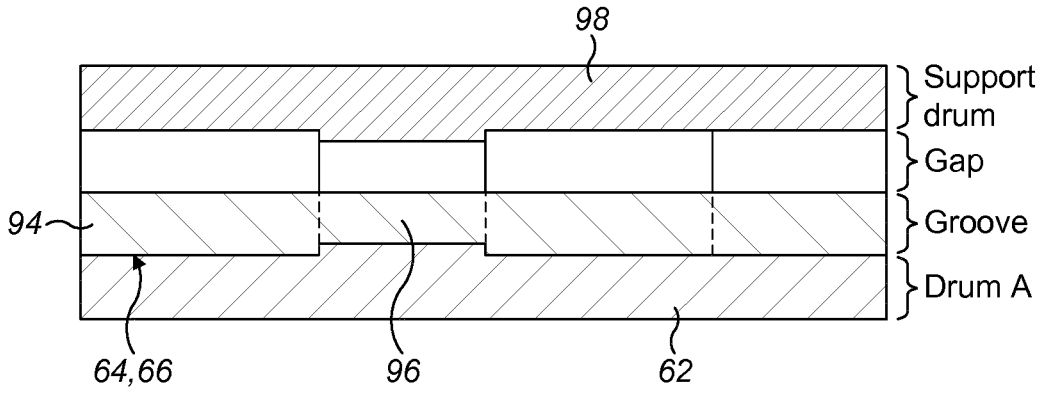
FIGS. 13*a* to 13*c* are cross-sectional views along the line B-B in FIG. 11.
Figure 13B:
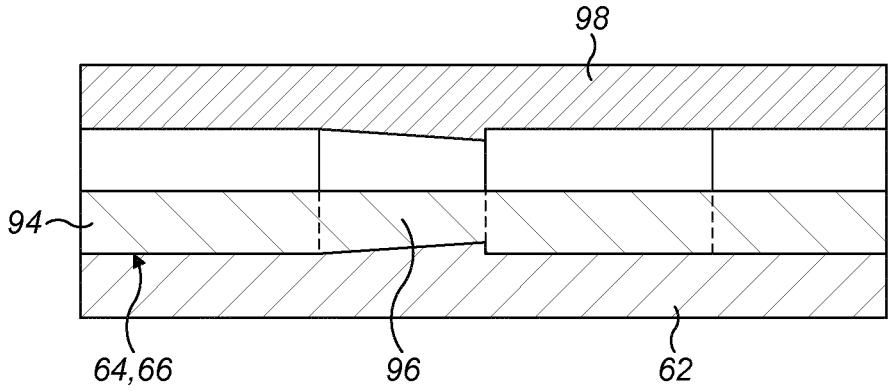
Figure 13C:
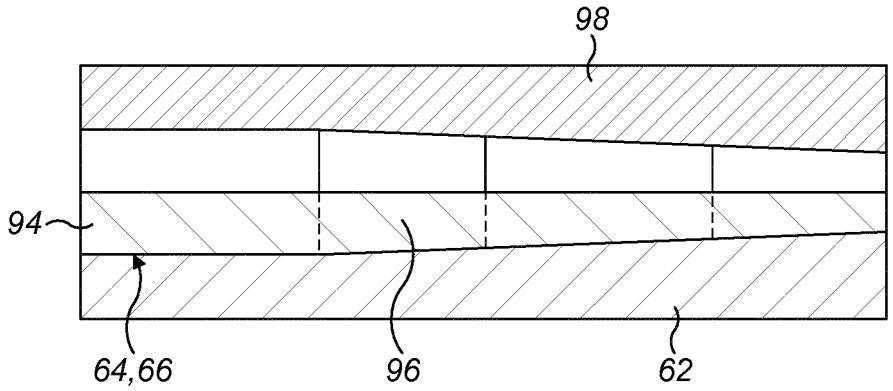

The aerosol generating material 10 is supported in the grooves 64 by a support drum 98, for example during positioning of the inductively heatable susceptor element 22 in the first region 12 of the aerosol generating material at position 04 as described in detail above. As best seen in FIGS. 13*a* to 13*c*, the support drum 98 has a geometry which conforms to the geometry of the grooves 64, for example as shown in FIGS. 12*a* to 12*c*, to ensure that the aerosol generating material 10 is adequately supported in the grooves 64, and to ensure that the second region 14 of the aerosol generating material 10 positioned in the second receiving section 96 is adequately compressed during insertion of the inductively heatable susceptor element 22 into the first region 12 of the aerosol generating material 10 at position 04.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments.

Any combination of the above-described features in all possible variations thereof is encompassed by the present disclosure unless otherwise indicated herein or otherwise clearly contradicted by context.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. A method for manufacturing cylindrical inductively heatable aerosol generating articles, the method comprising:

(i) supplying a plurality of cylindrical aerosol generating articles to a plurality of first receiving portions of a first transfer unit;

(ii) supplying a plurality of inductively heatable susceptor elements to a second receiving portion of a second unit;

(iii) aligning a longitudinal direction of the first receiving portions and a longitudinal direction of the second receiving portion;

(iv) sequentially positioning one of said inductively heatable susceptor elements in each of said cylindrical aerosol generating articles by sequentially moving each of the cylindrical aerosol generating articles supplied to the first receiving portions and the inductively heatable susceptor elements supplied to the second receiving portion relative to each other.

2. The method according to claim 1, wherein the first receiving portions are formed on a surface of the first transfer unit and step (i) comprises supplying the cylindrical aerosol generating articles to the plurality of first receiving portions in a direction perpendicular to the longitudinal direction of the first receiving portions.

3. The method according to claim 2, wherein the first receiving portions comprise a plurality of grooves and step (i) comprises supplying the cylindrical aerosol generating articles from an upper side of the grooves.

4. The method according to claim 1, wherein the first transfer unit transfers the cylindrical aerosol generating articles along a first path, preferably the first path includes a curved path at least part of which is circular.

5. The method according to claim 4, wherein the second unit transfers the inductively heatable susceptor elements along at least part or the whole of the first path.

6. The method according to claim 4, wherein step (iv) is conducted whilst the cylindrical aerosol generating articles and the inductively heatable susceptor elements are transferred along the same curved path as the second unit.

7. The method according to claim 1, further comprising:

(v) removing the cylindrical inductively heatable aerosol generating articles with the inductively heatable susceptor elements positioned therein from the first transfer unit or the second unit.

8. The method according to claim 7, wherein step (v) is conducted by moving the cylindrical inductively heatable aerosol generating articles in a direction perpendicular to the longitudinal direction of the first receiving portions.

9. The method according to claim 1, wherein:

each aerosol generating article comprises aerosol generating material having first and second regions in which the first region is located upstream or downstream of the second region relative to an aerosol flow direction within the article;

the aerosol generating material has a first end, a second end and an intermediate point between the first and second ends; and step (iv) comprises inserting the inductively heatable susceptor element into the first region from the first end or the second end so that it extends to the intermediate point and supporting the aerosol generating material at the opposite one of the first and second ends during insertion of the inductively heatable susceptor element into the first region.

10. The method according to claim 1, wherein:

each aerosol generating article comprises aerosol generating material having first and second regions in which the first region is located upstream or downstream of the second region relative to an aerosol flow direction within the article;

the aerosol generating material has a first end, a second end and an intermediate point between the first and second ends; and step (iv) comprises inserting the inductively heatable susceptor element into the first region from the first end or the second end so that it extends to the intermediate point and compressing the aerosol generating material in the second region in a direction perpendicular to an axis of the aerosol generating material or the direction of insertion during insertion of the inductively heatable susceptor element into the first region.

11. An apparatus for manufacturing cylindrical inductively heatable aerosol generating articles, the apparatus comprising:

a first transfer unit including a plurality of first receiving portions each for receiving a cylindrical aerosol generating article;

a second unit including a second receiving portion for receiving a plurality of inductively heatable susceptor elements;

a first supply unit for continuously supplying a plurality of the aerosol generating articles to the first receiving portions;

a second supply unit for continuously and sequentially supplying a plurality of the inductively heatable susceptor elements to the second receiving portion; and a positioning unit for sequentially positioning one of said inductively heatable susceptor elements in each of said cylindrical aerosol generating articles by sequentially moving each of the cylindrical aerosol generating articles supplied to the first receiving portions and the inductively heatable susceptor elements supplied to the second receiving portion relative to each other.

12. The apparatus according to claim 11, wherein the first transfer unit and the second unit are integrally formed and a longitudinal direction of the second receiving portion is aligned with a longitudinal direction of the first receiving portions.

13. The apparatus according to claim 11, wherein the first receiving portions and/or the second receiving portion comprise a retaining mechanism respectively to retain the cylindrical aerosol generating articles in the first receiving portions and/or to retain the inductively heatable susceptor element in the second receiving portion.

14. The apparatus according to claim 11, wherein the positioning unit includes a movement mechanism to move the cylindrical aerosol generating articles and/or the inductively heatable susceptor element relative to each other.

15. The apparatus according to claim 14, wherein the each of the inductively heatable susceptor elements is tubular and the movement mechanism comprises a pusher mechanism having a tapered part which can be partially inserted into an end of each of the tubular inductively heatable susceptor elements.

16. The apparatus according to claim 11, further comprising a guide for guiding the movement of the cylindrical aerosol generating articles and/or the inductively heatable susceptor elements.

17. The apparatus according to claim 11, wherein:

the first transfer unit is a drum and the first receiving portions are formed around an outer surface of the drum such that a longitudinal direction of the first receiving portions is parallel with a rotational axis of the drum.

18. The apparatus according to claim 11, wherein the first transfer unit comprises a first drum and the second unit comprises a second drum, and the first and second drums are configured to rotate in synchronisation with each other.

* * * * *